US012018550B2

(12) United States Patent
Al-Mousa et al.

(10) Patent No.: US 12,018,550 B2
(45) Date of Patent: Jun. 25, 2024

(54) SELF-RUNNING LOWER COMPLETION SCREEN

(71) Applicant: SAUDI ARABIAN OIL COMPANY, Dhahran (SA)

(72) Inventors: Ahmed A. Al-Mousa, Dhahran (SA); Linlin Wang, Dhahran (SA)

(73) Assignee: SAUDI ARABIAN OIL COMPANY, Dhahran (SA)

( * ) Notice: Subject to any disclaimer, the term of this patent is extended or adjusted under 35 U.S.C. 154(b) by 0 days.

(21) Appl. No.: 18/050,919

(22) Filed: Oct. 28, 2022

(65) Prior Publication Data

US 2024/0141760 A1 May 2, 2024

(51) Int. Cl.

| | |
|---|---|
| ***E21B 43/10*** | (2006.01) |
| ***E21B 23/00*** | (2006.01) |
| ***E21B 43/08*** | (2006.01) |

(52) U.S. Cl.

CPC ..... *E21B 43/10* (2013.01); *E21B 23/001* (2020.05); *E21B 43/08* (2013.01)

(58) Field of Classification Search

CPC ..... E21B 43/08; E21B 43/10; E21B 23/001
See application file for complete search history.

(56) References Cited

U.S. PATENT DOCUMENTS

| | | | | |
|---|---|---|---|---|
| 3,039,535 | A * | 6/1962 | Hathorn | E21B 43/082 166/228 |
| 7,546,875 | B2 | 6/2009 | Whitsitt et al. | |
| 9,004,183 | B2 * | 4/2015 | Fay | E21B 43/10 166/380 |
| 2005/0034873 | A1 * | 2/2005 | Coon | E21B 47/135 166/380 |
| 2015/0315880 | A1 | 11/2015 | Russell | |

FOREIGN PATENT DOCUMENTS

| | | |
|---|---|---|
| EP | 1397578 B1 | 8/2007 |

* cited by examiner

*Primary Examiner* — D. Andrews
(74) *Attorney, Agent, or Firm* — Osha Bergman Watanabe & Burton LLP

(57) ABSTRACT

A lower completion screen, for operating in a wellbore, includes: a body; a screening surface disposed on the body, wherein the screening surface includes a plurality of holes; a plurality of rollers disposed on the body; and a power system. A first group of the plurality of rollers is disposed on a first end of the body, and a second group of the plurality of rollers is disposed on a second end of the body. The power system is disposed on the second end of the body, and controls movement of the lower completion screen in the wellbore.

10 Claims, 5 Drawing Sheets

SELF-RUNNING LOWER COMPLETION SCREEN

BACKGROUND

Hydrocarbon fluids are often found in hydrocarbon reservoirs located in porous rock formations below the surface of the Earth. Wells are drilled into the reservoirs to access and produce the hydrocarbons. A well is drilled by running a drill string, having a drill bit and a bottom hole assembly, into a wellbore to break the rock and extend the depth of the wellbore. Each wellbore is supported by a casing string cemented in place. Several operations for completing and working over the wellbore require running a lower completion system in order to produce the oil from a hydrocarbon production zone. One of the main limitations of running the conventional lower completion systems is the need to use drill pipes to convey and place the lower completion systems in deep parts of the wellbore and inside the casing.

SUMMARY

This summary is provided to introduce a selection of concepts that are further described below in the detailed description. This summary is not intended to identify key or essential features of the claimed subject matter, nor it is intended to be used as an aid in limiting the scope of the claimed subject matter.

This disclosure presents, in accordance with one or more embodiments, a lower completion screen for operating in a wellbore. The lower completion screen comprises a body and a screening surface disposed on the body. The screening surface comprises a plurality of holes. The lower completion screen also comprises a plurality of rollers disposed on the body. A first group of the plurality of rollers is disposed on a first end of the body and a second group of the plurality of rollers is disposed on a second end of the body. Further, the lower completion screen comprises a power system disposed on the second end of the body. The power system controls movement of the lower completion screen in the wellbore.

Other aspects and advantages of the invention will be apparent from the following description and the appended claims.

BRIEF DESCRIPTION OF DRAWINGS

Specific embodiments of the disclosed technology will now be described in detail with reference to the accompanying figures. Like elements in the various figures are denoted by like reference numerals for consistency. The sizes and relative positions of elements in the drawings are not necessarily drawn to scale. For example, the shapes of various elements and angles are not necessarily drawn to scale, and some of these elements may be arbitrarily enlarged and positioned to improve drawing legibility. Further, the particular shapes of the elements as drawn are not necessarily intended to convey any information regarding the actual shape of the particular elements and have been solely selected for ease of recognition in the drawing.

DETAILED DESCRIPTION

Figure 1:
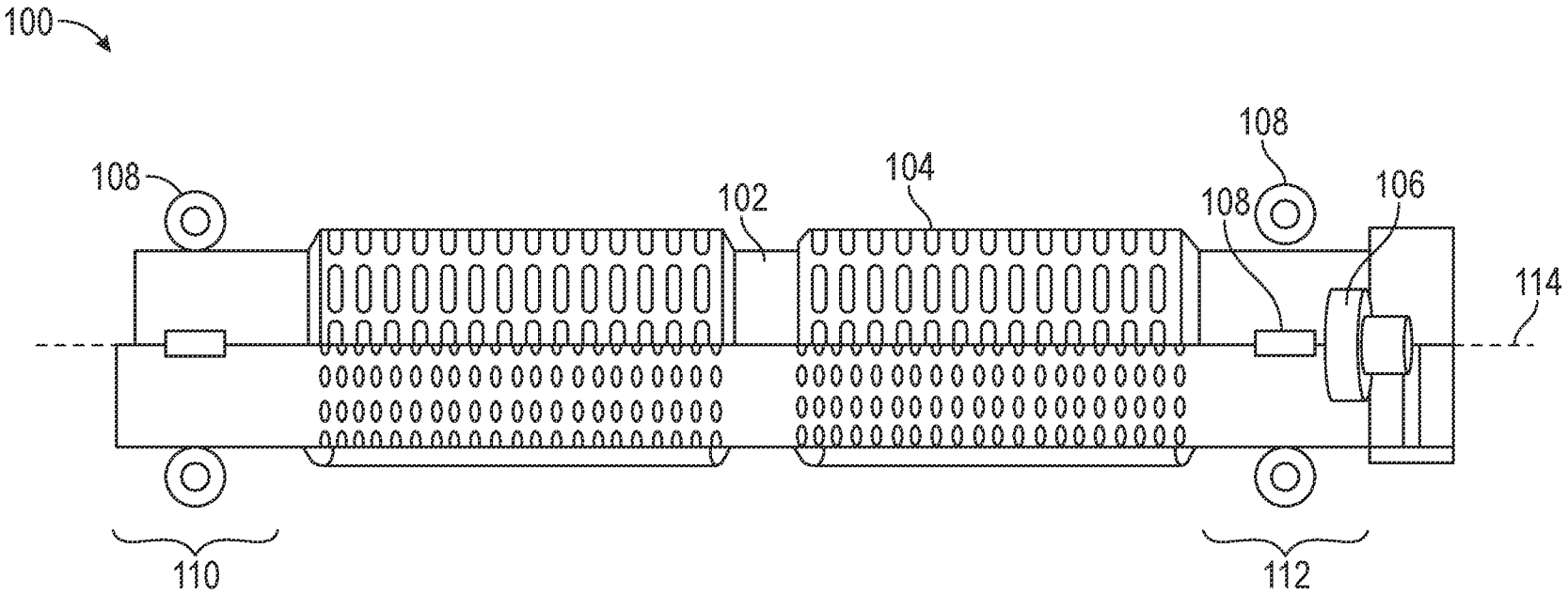
FIG. 1 shows a side view of a lower completion screen in accordance with one or more embodiments.

In the following detailed description of embodiments of the disclosure, numerous specific details are set forth in order to provide a more thorough understanding of the disclosure. However, it will be apparent to one of ordinary skill in the art that the disclosure may be practiced without these specific details. In other instances, well-known features have not been described in detail to avoid unnecessarily complicating the description.

Throughout the disclosure, ordinal numbers (e.g., first, second, third, etc.) may be used as an adjective for an element (i.e., any noun in the application). The use of ordinal numbers is not to imply or create any particular ordering of the elements nor to limit any element to being only a single element unless expressly disclosed, such as using the terms "before", "after", "single", and other such terminology. Rather, the use of ordinal numbers is to distinguish between the elements. By way of an example, a first element is distinct from a second element, and the first element may encompass more than one element and succeed (or precede) the second element in an ordering of elements.

Several operations while completing and working over wells require running a lower completion system in order to produce oil from a hydrocarbon production zone. The lower completion system may be a lower completion screen. The lower completion screen may include holes on its surface to filter the oil from sand or rock and to block sand or rock from entering the well. Although the lower completion screen is used for producing oil, one of ordinary skill in the art can recognize that the lower completion screen can also be used for producing other types of fluid such as water.

One of the limitations of the conventional lower completion screens is the need to use drill pipes to convey and place the conventional lower completion screens in deep parts of the wellbore and inside the casing. The conventional lower completion screens are not designed for self-running inside the wellbore. In addition, the conventional lower completion screens have to install centralizers to increase stand-off of the conventional lower completion screens so that the screens can pass through rough areas of the lower parts of the wellbore. However, the installed centralizers have blades and cause face-to-face frictions with the inner walls of the wellbore. Therefore, even with the installed centralizers, there are difficulties in operating the conventional lower completion screens. In particular, the difficulties increase when the conventional lower completion screens operate in horizontal laterals with high dog leg severities. Therefore, in many cases, the conventional lower completion screens are more likely to be differential stuck during a stationary time period, in horizontal laterals, whenever wellbores have high overbalance mud weight.

The lower completion screen according to one or more embodiments of the invention can move and operate in the wellbore automatically and independently. Thus, because conveying drill pipes is not needed to run the self-running lower completion screen, the self-running lower completion screen saves the rig time and cost, and minimizes the risks of injuries related to handling the drill pipes.

In addition, when running a conventional lower completion screen, there are times when the conventional lower completion screen stays stationary in an open hole during connecting the drill pipes. This increases the risk of the conventional lower completion screen being differential stuck inside the open hole. On the other hand, the self-running lower completion screen minimizes this risk because the self-running lower completion screen can move continuously from the beginning until it reaches to the desired depth. The self-running lower completion screen has rollers, and may not include centralizers. The rollers help the self-running lower completion screen pass through the open hole with high drilling dogleg severity.

Throughout this description, the "conventional lower completion screen" refers to the tradition lower completion screen that requires using drill pipes for moving the conventional lower completion screen in the wellbore, and the "lower completion screen" refers to the "self-running lower completion screen."

FIG. 1 shows a side view of a lower completion screen (100) according to one or more embodiments of the invention. The length of the lower completion screen (100) is determined based on different factors such as a length of the hydrocarbon production zone. For example, the length of the lower completion screen (100) may be 40 feet. The lower completion screen (100) includes a body (102) and a screening surface (104) that is disposed on the body (102). The screening surface (104) includes a plurality of holes on its surface. When the lower completion screen (100) is placed in the hydrocarbon production zone, the holes can filter the oil from sand or rock when the oil enters the well, and can block sand or rock from entering the well. According to one or more embodiments, the body (102) has a cylindrical shape. However, one of ordinary skill in the art appreciates that the shape of the body (102) may deviate and have other shapes based on a specific design or function of the lower completion screen (100).

The lower completion screen (100) also includes 8 rollers (108) that are disposed on the body (102). A first group of the of rollers that includes 4 rollers (108) is disposed on a first end of the body (110) and a second group of the rollers that also includes 4 rollers (108) is disposed on a second end of the body (112). In FIG. 1, one roller (108) is disposed on the backside of each of the first end of the body (110) and second end of the body (112) and thus, is not shown in FIG. 1. The rollers (108) are disposed concentric with respect to the axial direction of the lower completion screen (114). The rollers, however, may be disposed differently, depending on a specific design and function of the lower completion screen.

The rollers (108) carry the lower completion screen (100) in the wellbore, and reduce friction with the inner-walls of the wellbore or casings while the lower completion screen (100) moves inside the wellbore. While FIG. 1 shows that the lower completion screen (100) includes 8 rollers (108), the number of the rollers is not limited to 8, and the number of the rollers in each end is also not limited to 4, and these numbers may vary depending on a specific design or function of the lower completion screen. For example, there may be 2, 3, or 5 rollers (108) on any of the ends of the body (102).

The lower completion screen (100) also includes a power system (106) disposed on the second end of the body (112). The power system (106) powers at least one of the rollers (108), and thereby controls movement of the lower completion screen (100) inside the wellbore. According to one or more embodiments, the second end of the body (112) where the power system (106) is disposed is the end of the body that is disposed downward with respect to the first end of the body (110), when the lower completion screen (100) is disposed or operates in the wellbore. Because the power system (106) is located on the lower completion screen (100), the lower completion screen (100) can move to a desired depth of the wellbore, and there is no need for using pipes to place the lower completion screen (100) in the desired depth.

Figure 2:
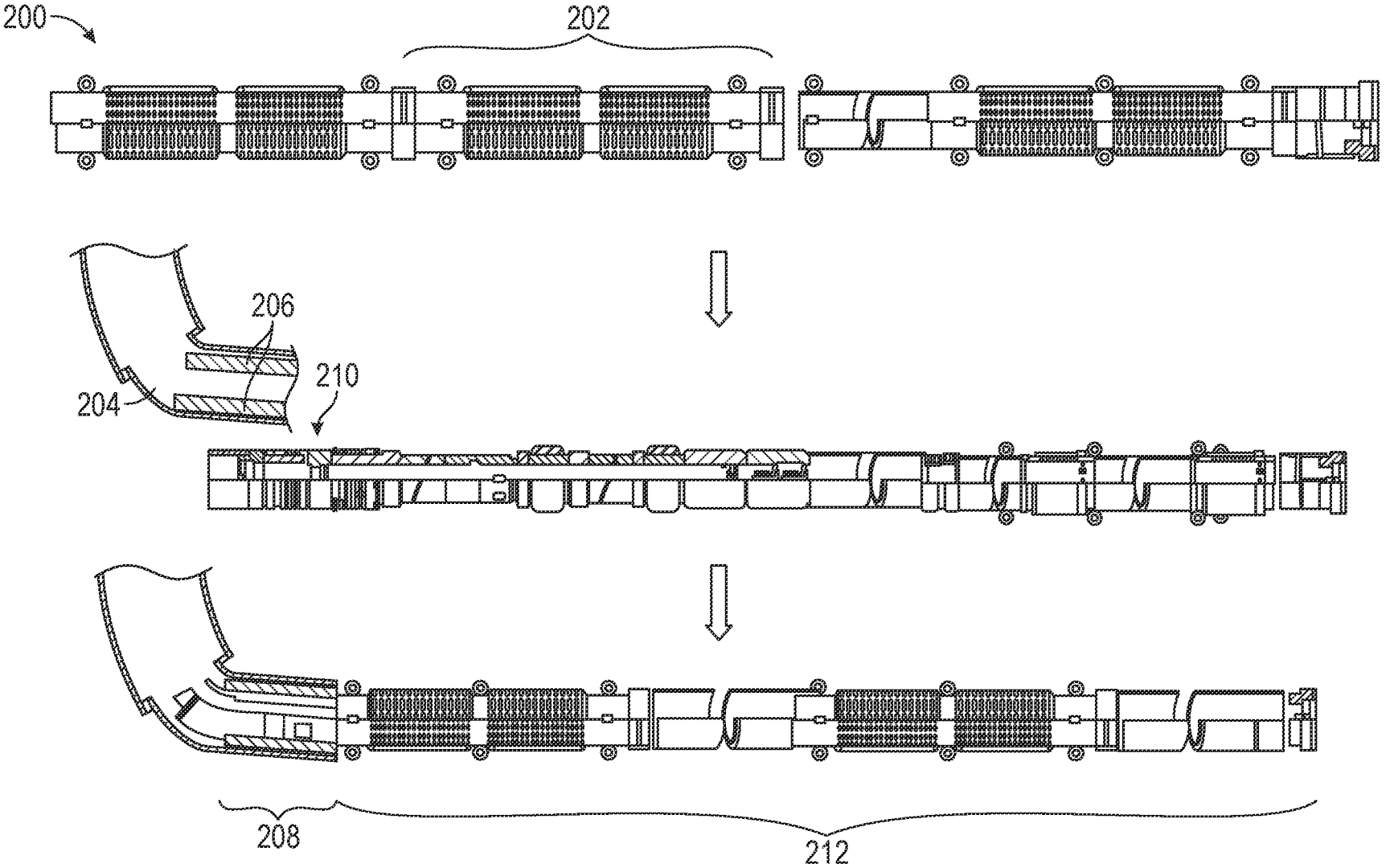
FIG. 2 shows a side view of a lower completion string in accordance with one or more embodiments.

FIG. 2 shows a side view of placement of a lower completion string (200) inside a production zone of a wellbore, in accordance with one or more embodiments of the invention. FIG. 2, in the top row, shows the lower completion string (200) that is made by assembling a plurality of lower completion screens (202) together. The number of the lower completion screens (202) in the lower completion string (200) depends on the length of the production zone and may be one or more than one.

In one or more embodiments, each of the lower completion screens (202) in the lower completion string (200) is similar to the lower completion screen (100) described with reference to FIG. 1. Further, in one or more embodiments, each of the lower completion screens (202) in the lower completion string (200) may include a respective power system similar to the power system (106) described with reference to FIG. 1. In other embodiments, some of the lower completion screens (202) may not have their own power system, and one or more power systems of one or more of the other lower completion screens (202) may control movement of the entire lower completion string (200). The length of the lower completion string (200) may be determined based on the total length of the production zone.

FIG. 2, in the middle row, shows the lower part of the previous casing (204) in a wellbore cased hole and the upper part of the lower completion string (210), which will run into the wellbore open hole. The lower part of the previous casing (204) has tie-back seals (206), and the upper part of the lower completion string (210) also has seals. As shown in FIG. 2, in the bottom row, the tie-back seals (206) of the lower part of the previous casing (204) overlap with the seals of the upper part of the lower completion string (210). As soon as the lower completion string (200) runs to the bottom part of the wellbore (212) (e.g., the open hole), the seals of the upper part of the lower completion string (210) will be set inside the tie-back seals (206) of the lower part of the previous casing (204), and seal the connection (208). This way, the whole system is set in place, and the integrity of the wellbore is maintained.

Figure 3:
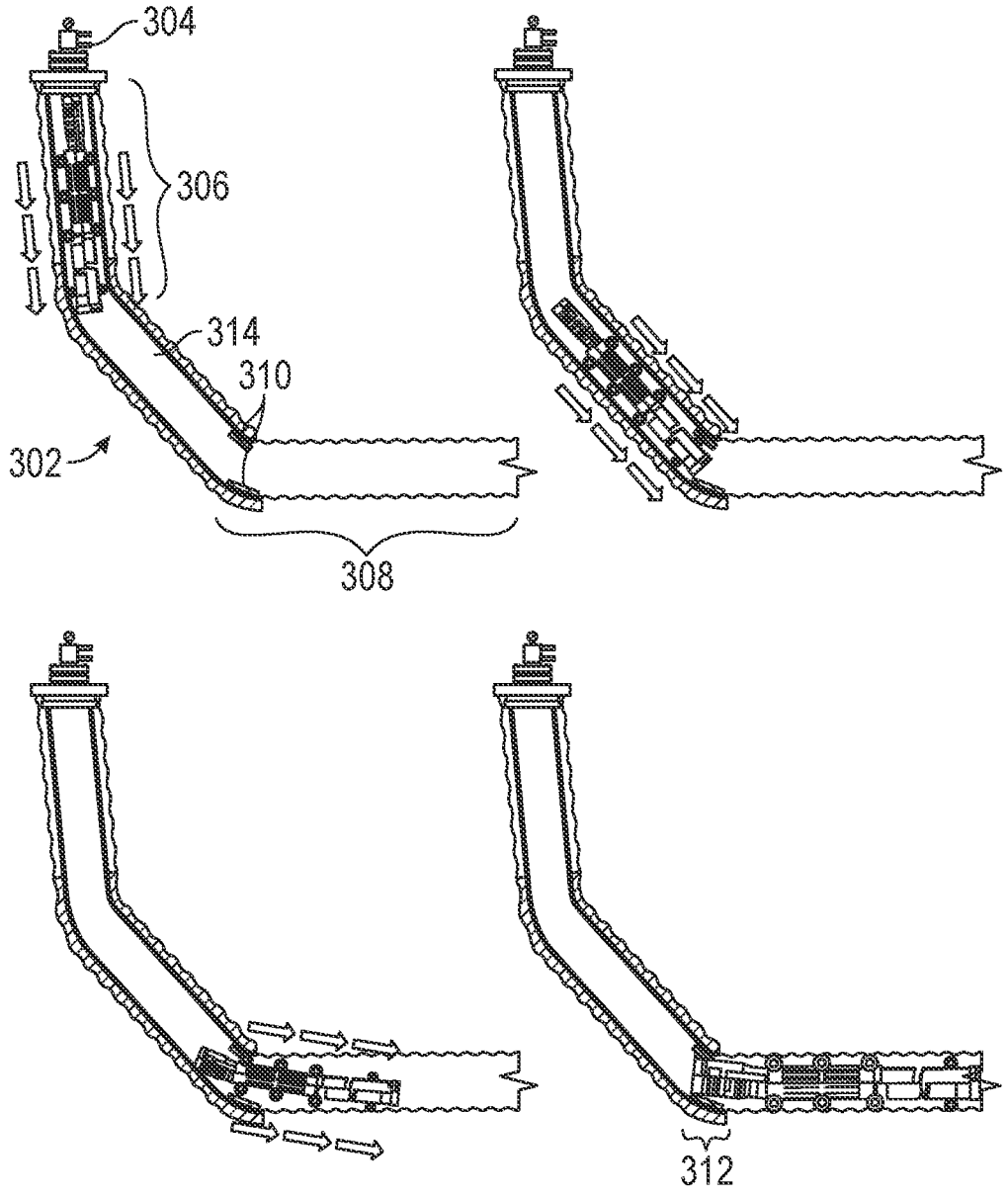
FIG. 3 shows movement and placement of a lower completion screen inside a wellbore in accordance with one or more embodiments.

FIG. 3 shows automatic movement of a self-running lower completion string (306) inside a wellbore from the top portion of the wellbore (304) to the cased hole (314) and then to the open hole (308), in accordance with one or more embodiments. In these embodiments, there is no need for using a drilling pipe to move the lower completion string (306). Although, one lower completion screen is shown in FIG. 3 for simplicity of illustration, one of ordinary skill in the art recognizes that the lower completion string (306) may include a plurality of lower completion screens depending on the length of the production zone.

As soon as the lower completion string (306) moves into the open hole, friction forces between the lower completion string (306) and the walls of the open hole (308) may overcome gravity forces. In this case, the power system(s) that is on the lower completion string (306) can continue carrying the lower completion string (306) to the open hole (308) to a desired location, for example to the bottom of the wellbore (302). Accordingly, the self-running lower completion string according to the embodiments of the invention can be particularly useful for horizontal open holes where friction forces dominate gravity forces. The bottom right section of FIG. 3 shows that when the lower completion string (306) is placed in the open hole (308) in the desired location of the wellbore (302), the top of lower completion string (306) moves inside the tie-back seals (310) of the previous wellbore casing, and seals the connection (312). Then the whole system is in place and the integrity of the wellbore (302) is maintained.

When the self-running lower completion string is placed in the wellbore, the gravity will force the entire string moving down fast. The falling down force may damage the bottom of the lower completion string. According to one or more embodiments, the self-running lower completion string includes an electromagnetic damping system to control and reduce the speed of the rollers, and thereby to reduce the speed of the lower completion string, when the speed becomes more than a predetermined value.

Figure 4:
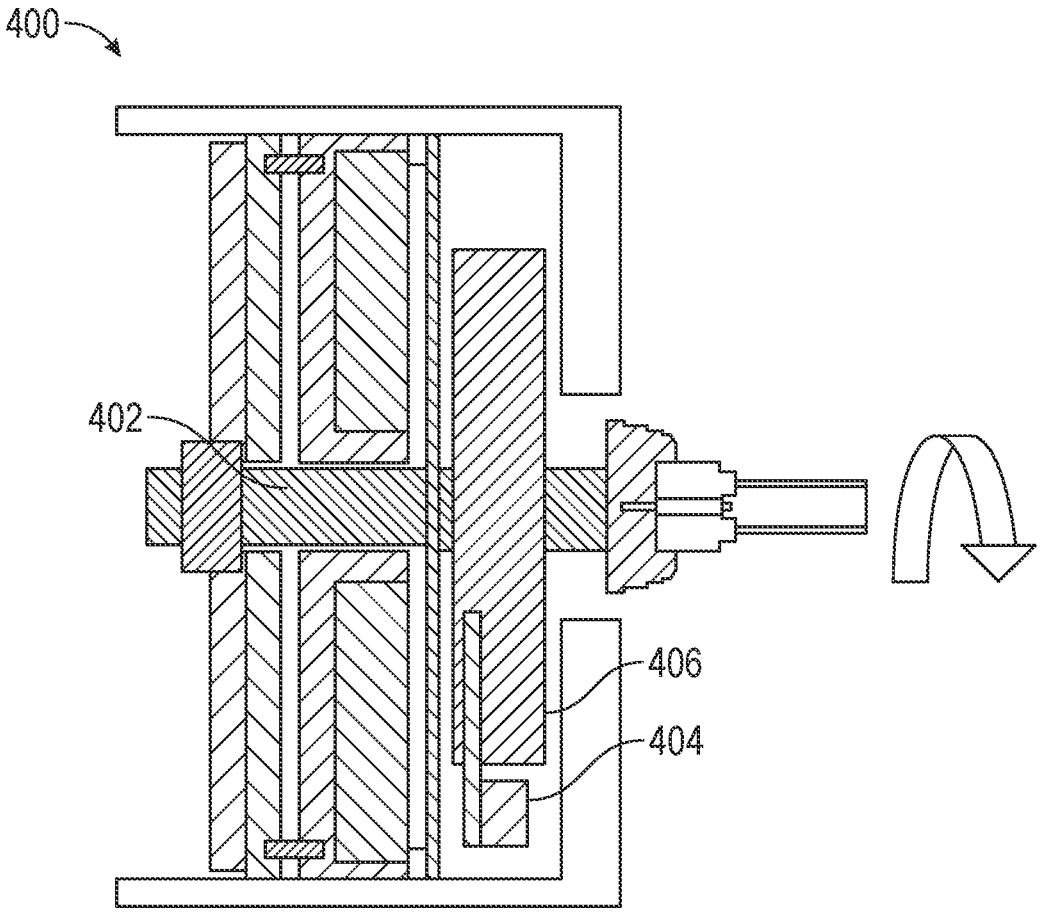
FIG. 4 shows a cross-sectional view of an electromagnetic damping system in accordance with one or more embodiments.

FIG. 4 shows a cross-sectional view of an electromagnetic damping system (400) in accordance with one or more embodiments. The electromagnetic damping system (400) includes a pinion shaft (402), a steering rack, a friction disc (406) that is operatively coupled to the pinion shaft (402), and an electromagnetic clutch (404) disposed near the friction disc (406). The right end of the pinion shaft (402) is connected to a steering gearbox and to a transmission shaft inside the power system. When the rollers rotate faster than a predetermined speed, the electromagnetic clutch (404) contacts the friction disc (406) to suppress the moving speed of the friction disc (406), and thereby to suppress the speed of the pinion shaft (402) and the rollers.

In one or more embodiments, the power system may include an electric motor. The electric motor may control torque and speed of the power system, and thereby the torque and speed of the rollers, using magnetization state of the electric motor. In these embodiments, an electromagnetic damping system may not be required, because the electric motor can suppress the speed of the rollers by changing the magnetization sate of the electric motor to a magnetization state where speed is lower and torque is higher.

Figure 5:
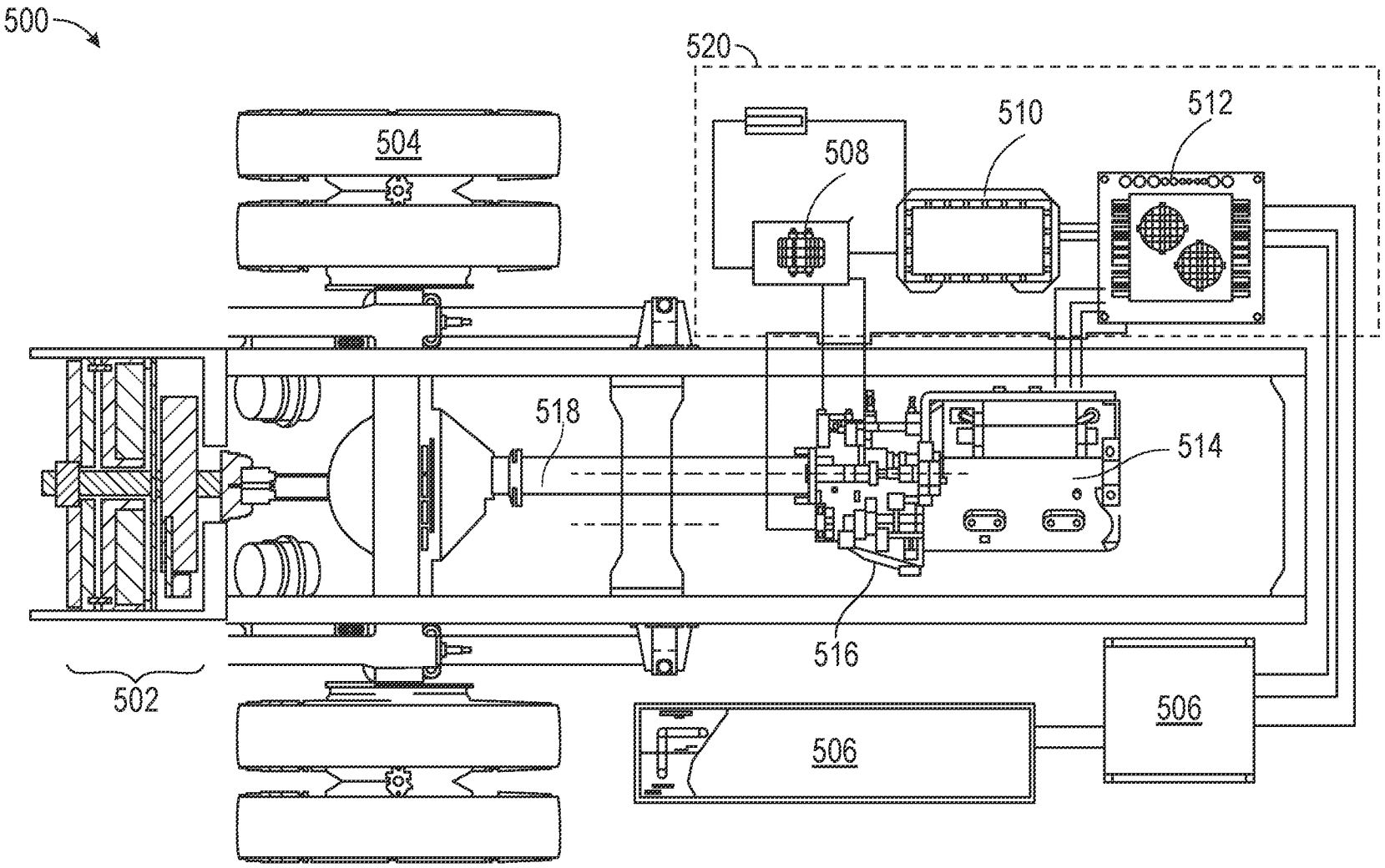
FIG. 5 shows a power system for running a lower completion screen in accordance with one or more embodiments.

As described above, the lower completion screen according to the embodiments of the invention includes a power system. FIG. 5 shows a layout of a power system (500) that powers the rollers (504) in accordance with one or more embodiments of the invention. The power system (500) is coupled to an electromagnetic damping system (502). An example of the electromagnetic damping system (502) is described above with respect to FIG. 4. The power system (500) includes a motor (514), a battery (506), a steering gearbox (516), a transmission shaft (518), and a control unit (520) that controls operation of the power system (500). The control unit (520) includes a speed sensor (512) that detects the moving speed of the lower completion string or the speed of the rollers (504), a depth sensor (510) that detects the depth of the wellbore at which the lower completion string is located, and a switch (508) that can switch the motor (514) on and off.

When the speed sensor (512) detects that the moving speed of the lower completion string drops to below a first predetermined value, the switch (508) may switch to "ON" to turn on the motor (514). Then, the motor (514) generates rotational torque and transmits the rotational torque, via the gearbox (516), to the rollers (504). Accordingly, the moving speed of the lower completion string increases to or above the first predetermined value. Similarly, when the speed sensor (512) detects the moving speed of the lower completion string increases to more than a second predetermined value, the switch (508) may switch to "OFF" to turn off the motor (514). Also, the electromagnetic damping system (502) may be activated to reduce the speed of the lower completion string, as described with respect to FIG. 4. Accordingly, the moving speed of the lower completion string decreases to or below the second predetermined value.

As soon as the depth sensor (510) detects that the lower completion string has reached a predetermined depth of the wellbore, then the switch (508) may switch to "OFF," and the lower completion string stays in the predetermined depth of the wellbore.

In one or more embodiments, the motor (514) may be an electric motor. To control the moving speed of the lower completion string, instead of or in addition to using the switch (508), the control unit (520) may control the magnetization state of the electric motor to change the speed and torque of the electric motor. For example, the control unit (520) may apply electric pulses, which are generated by a pulse generator, to the electric motor to change the magnetization state of the electric motor. By controlling the magnetization state of the electric motor, the speed and torque of the electric motor can be controlled, and thereby the moving speed of the lower completion string can be controlled.

Using the power system disclosed in accordance with one or more embodiments, the lower completion string can pass obstacles and with minimum vibrations, and increase safety and efficiency. In one or more embodiments, both gravitational potential energy and electrical energy can be used to automatically (i.e., without using drill pipes) place the lower completion string in any desired location of the wellbore regardless of the well being vertical or horizontal. In addition to lower vibrations, using the electric motor in the power system enables cleaner operational environment that using conventional tools that function with diesel.

Although only a few example embodiments have been described in detail above, those skilled in the art will readily appreciate that many modifications are possible in the example embodiments without materially departing from this invention. Accordingly, all such modifications are intended to be included within the scope of this disclosure as defined in the following claims.

In the claims, means-plus-function clauses are intended to cover the structures described herein as performing the recited function and not only structural equivalents, but also equivalent structures. For example, although a nail and a screw may not be structural equivalents in that a nail employs a cylindrical surface to secure wooden parts together, whereas a screw employs a helical surface, in the environment of fastening wooden parts, a nail and a screw may be equivalent structures. It is the express intention of the applicant not to invoke 35 U.S.C. § 112(f) for any limitations of any of the claims herein, except for those in which the claim expressly uses the words 'means for' together with an associated function.

What is claimed is:

1. A lower completion screen for operating in a wellbore, the lower completion screen comprising:

a body;

a screening surface disposed on the body, wherein the screening surface comprises a plurality of holes;

a plurality of rollers disposed on the body, wherein a first group of the plurality of rollers is disposed on a first end of the body and a second group of the plurality of rollers is disposed on a second end of the body; and a power system disposed on the second end of the body, wherein the power system controls movement of the lower completion screen in the wellbore, wherein the power system comprises an electric motor.

2. The lower completion screen of claim 1, wherein the second end where the power system is disposed is the end of the body of the lower completion screen that is disposed downward with respect to the first end of the body, when the lower completion screen is disposed or operates in the wellbore.

3. The lower completion screen of claim 1, wherein the power system comprises:

a speed sensor that detects a moving speed of the lower completion screen; and a depth sensor that detects a depth of the wellbore at which the lower completion screen is located in the wellbore, wherein the power system controls the moving speed of the lower completion screen based on the moving speed detected by the speed sensor, and wherein the power system controls the movement of the lower completion screen based on the depth of the wellbore detected by the depth sensor.

4. The lower completion screen of claim 1, wherein the power system comprises an electromagnetic damping system that controls speed and torque of the power system.

5. The lower completion screen of claim 4, wherein the electromagnetic damping system comprises:

a friction disc; and an electromagnetic clutch, wherein when a moving speed of the lower completion screen becomes more than a predetermined moving speed, the electromagnetic clutch contacts the friction disc to reduce a rotation speed of the friction disc and thereby to reduce the moving speed of the lower completion screen.

6. The lower completion screen of claim 5 further comprising:

a pinion shaft coupled to the friction disc; and a steering gearbox connected to the pinion shaft.

7. The lower completion screen of claim 1, wherein each of the first group and second group of the plurality of rollers comprises 4 rollers.

8. The lower completion screen of claim 7, wherein the 4 rollers in each of the first group and second group of the plurality of rollers are disposed concentric with respect to an axial direction of the lower completion screen.

9. A lower completion string that comprises the lower completion screen of claim 1.

10. A lower completion string that comprises a plurality of the lower completion screen according to claim 1, wherein each of the lower completion screen comprises the respective power system that controls movement of the respective lower completion screen in the wellbore.

* * * * *